US011653722B2

(12) United States Patent
Wu

(10) Patent No.: US 11,653,722 B2
(45) Date of Patent: May 23, 2023

(54) MULTI-POINT SAFETY BELT BUCKLE WITH DUSTPROOF FUNCTION

(71) Applicant: TAIWAN RACING PRODUCTS CO., LTD., Changhua Hsien (TW)

(72) Inventor: Wen-Yuan Wu, Changhua Hsien (TW)

(73) Assignee: TAIWAN RACING PRODUCTS CO., LTD., Changhua Hsien (TW)

( * ) Notice: Subject to any disclaimer, the term of this patent is extended or adjusted under 35 U.S.C. 154(b) by 0 days.

(21) Appl. No.: 17/505,777

(22) Filed: Oct. 20, 2021

(65) Prior Publication Data

US 2023/0123880 A1 Apr. 20, 2023

(51) Int. Cl.
*A44B 11/25* (2006.01)

(52) U.S. Cl.
CPC ..... *A44B 11/2542* (2013.01); *A44B 11/2576* (2013.01)

(58) Field of Classification Search
CPC ..... A44B 11/2542; A44B 11/2569; A44B 11/2576
See application file for complete search history.

(56) References Cited

U.S. PATENT DOCUMENTS 9,867,432 B1 * 1/2018 Wu ..... A44B 11/2542
2013/0212845 A1 * 8/2013 Ford ..... A44B 11/2569 24/602

* cited by examiner

*Primary Examiner* — Robert Sandy
*Assistant Examiner* — Michael S Lee
(74) *Attorney, Agent, or Firm* — Karin L. Williams; Alan D. Kamrath; Mayer & Williams PC

(57) ABSTRACT

A safety belt buckle includes a buckle body, a plurality of latch plates, and a dustproof cover. The buckle body includes a base having a plurality of insertion slots. The dustproof cover is mounted on the base and has a plurality of passages. Each of the latch plates has a locking portion inserted through one of the passages of the dustproof cover into one of the insertion slots of the base. The locking portion has a clamping section arranged between each of the latch plates and the base. The clamping section of each of the latch plates seals one of the passages of the dustproof cover and stops one of the insertion slots of the base. The locking portion of each of the latch plates is clamped by one of the passages of the dustproof cover.

9 Claims, 6 Drawing Sheets

MULTI-POINT SAFETY BELT BUCKLE WITH DUSTPROOF FUNCTION

BACKGROUND OF THE INVENTION

1. Field of the Invention

The present invention relates to a safety belt buckle and, more particularly, to a multi-point safety belt buckle for a safety belt of a race car.

2. Description of the Related Art

A conventional front-hanging safety belt buckle in accordance with the prior art shown in FIGS. 5 and 6 comprises a base 4, a plurality of spring-biased push members 45, a cover 5, a locking device 6, a rotation member 7, and a torsion spring 73. The base 4 has a top provided with a plurality of slideways 42. The top of the base 4 has a center provided with a recessed flange 41, and each of the slideways 42 extends from the recessed flange 41 to a periphery of the base 4. The top of the base 4 is provided with a plurality of abutting pieces 411. The periphery of the base 4 is provided with an annular portion 43, a plurality of spacing blocks 44, and a plurality of insertion slots 440. The insertion slots 440 are arranged between the spacing blocks 44. The spring-biased push members 45 are mounted in the slideways 42. The cover 5 is mounted on the base 4 and has a top having a center provided with a perforation 51 and a bottom provided with a receiving space 50 connected to the perforation 51. The cover 5 is provided with an arcuate stop wall 52 surrounding the perforation 51. The receiving space 50 of the cover 5 is provided with a plurality of convex portions 53 and a plurality of pillars 54. The convex portions 53 are connected with the spacing blocks 44. The pillars 54 are arranged between the convex portions 53 and correspond to the slideways 42. The locking device 6 is mounted in the receiving space 50 of the cover 5 and includes a fixed post 63 mounted on one of the pillars 54 of the cover 5, a plurality of movable posts 62 mounted on the pillars 54 of the cover 5 and corresponding to the spring-biased push members 45, a plurality of springs 64 mounted on the pillars 54 of the cover 5 and located in the fixed post 63 and the movable posts 62, a conical spring 610 mounted in the receiving space 50 of the cover 5 and corresponding to the perforation 51 of the cover 5, a driven plate 61 mounted in the receiving space 50 of the cover 5 and abutting the conical spring 610, a driving shaft 65 mounted on the cover 5, and a fixed disk 8 arranged under the driven plate 61 and abutting the spacing blocks 44 of the base 4. The driven plate 61 of the locking device 6 has a central portion provided with a through hole 611 and a hollow lug 6111 and has a rim provided with a plurality of clamping grooves 6131 for clamping the movable posts 62. The clamping grooves 6131 are formed by projections 613 extending from the driven plate 61. The driven plate 61 of the locking device 6 is provided with a flat portion 612. The hollow lug 6111 of the driven plate 61 has a notch. The driving shaft 65 of the locking device 6 is provided with a rotation portion 651, an abutting portion 6511, and a push portion 652. The rotation portion 651 extends through the perforation 51 of the cover 5 and protrudes from the cover 5. The abutting portion 6511 rests on a wall of the perforation 51. The push portion 652 extends through the through hole 611 of the driven plate 61 and is provided with a pivot hole 6521, and a transverse axle 6522 extends through the pivot hole 6521 of the push portion 652 and rests on the hollow lug 6111 of the driven plate 61. The fixed disk 8 of the locking device 6 is arranged between the spacing blocks 44 of the base 4 and the convex portions 53 of the cover 5. The fixed disk 8 of the locking device 6 has a central portion provided with a retaining hole 81 to allow insertion of the abutting pieces 411 of the base 4 so as to position the fixed disk 8. The fixed disk 8 of the locking device 6 has a periphery provided with a plurality of passages 82 corresponding to the slideways 42 of the base 4. The fixed disk 8 of the locking device 6 has a rim provided with a plurality of openings 83. The fixed post 63 and the movable posts 62 of the locking device 6 extend through the passages 82 of the fixed disk 8. The openings 83 of the fixed disk 8 are mounted on the spacing blocks 44 of the base 4. The fixed post 63 of the locking device 6 is mounted on the flat portion 612 of the driven plate 61 and has an end provided with an interior hole 631 for mounting one of the springs 64. Each of the movable posts 62 of the locking device 6 has an end provided with an interior hole 621 for mounting one of the springs 64. The conical spring 610 of the locking device 6 is biased between the cover 5 and the driven plate 61 and abuts the top of the receiving space 50 of the cover 5. The rotation member 7 is mounted on the cover 5 and has an interior provided with a mounting space 70, an arcuate inner stop wall 71, and a pivot end 72. The mounting space 70 covers the stop wall 52 of the cover 5. The inner stop wall 71 is arranged in the stop wall 52 of the cover 5. The pivot end 72 is secured on the rotation portion 651 of the driving shaft 65 for rotating the driving shaft 65. The rotation member 7 has a periphery provided with a driving handle 74. The torsion spring 73 is provided with a hollow restoring portion 731 mounted on the pivot end 72 of the rotation member 7 and arranged in the inner stop wall 71 of the rotation member 7. The torsion spring 73 is provided with two push arms 732 extending from the restoring portion 731 and resting on the stop wall 52 of the cover 5 and the inner stop wall 71 of the rotation member 7.

In operation, when a latch plate of a safety belt is inserted into one of the insertion slots 440 of the base 4, one of the spring-biased push members 45 is pushed by the latch plate of the safety belt to compress a tensile spring, so that one of the spring-biased push members 45 is moved inward in one of the slideways 42 of the base 4. In such a manner, one of the movable posts 62 of the locking device 6 is released from one of the spring-biased push members 45 and is pushed downward by the restoring force of one of the springs 64 to lock a hole (not labeled) of the latch plate, so that the latch plate of the safety belt is locked by one of the movable posts 62 of the locking device 6 and retained by one of the spring-biased push members 45. On the contrary, when the driving handle 74 of the rotation member 7 is driven, the rotation member 7 is rotated, and the pivot end 72 of the rotation member 7 is driven to rotate the driving shaft 65 of the locking device 6. At this time, the transverse axle 6522 of the driving shaft 65 initially abuts the notch of the hollow lug 6111 of the driven plate 61. When the driving shaft 65 of the locking device 6 is rotated, the transverse axle 6522 of the driving shaft 65 is rotated and moved to press the hollow lug 6111, and the driven plate 61 is pushed upward to compress the conical spring 610, so that each of the movable posts 62 of the locking device 6 is moved upward by the driven plate 61 to release the latch plate of the safety belt, and each of the springs 64 is compressed. In such a manner, after the latch plate of the safety belt is unlocked from one of the movable posts 62 of the locking device 6, the latch plate of the safety belt and one of the spring-biased push members 45 are pushed outward by the restoring force of the tensile spring, so that the latch plate of the safety belt is detached from one of the insertion slots 440 of the base 4.

Thus, multiple safety belts are connected to a central multi-point safety belt buckle to protect the user so as to prevent the user from being detached from the seat due to a large impact. However, the conventional safety belt buckle does not have a dustproof function so that when the conventional safety belt buckle is used outdoors, dust, sand or mud is easily attached to the parts, thereby affecting operation of the conventional safety belt buckle.

BRIEF SUMMARY OF THE INVENTION

The primary objective of the present invention is to provide a multi-point safety belt buckle with a dustproof function.

In accordance with the present invention, there is provided a safety belt buckle comprising a buckle body, a plurality of latch plates, and a dustproof cover. The buckle body includes a base and a top cap. The base is combined with the top cap and has a periphery provided with a plurality of insertion slots. The latch plates are mounted on the buckle body. Each of the latch plates has a first end provided with a belt fastening portion and a second end provided with a locking portion. The locking portion of each of the latch plates is provided with a locking hole. The dustproof cover is mounted on a lower end of the base. The dustproof cover is provided with a plurality of passages aligning with the insertion slots of the base respectively, and the locking portion of each of the latch plates is inserted through one of the passages of the dustproof cover into one of the insertion slots of the base. The locking portion of each of the latch plates is provided with a clamping section. The clamping section of each of the latch plates is arranged between the belt fastening portion and the periphery of the base when the locking portion of each of the latch plates is inserted into one of the insertion slots of the base. The clamping section of each of the latch plates seals one of the passages of the dustproof cover and stops one of the insertion slots of the base when the locking portion of each of the latch plates is inserted through one of the passages of the dustproof cover into one of the insertion slots of the base. The locking portion of each of the latch plates is clamped by one of the passages of the dustproof cover when the locking portion of each of the latch plates is inserted through one of the passages of the dustproof cover into one of the insertion slots of the base.

According to the primary advantage of the present invention, each of the passages of the dustproof cover is closely fit on and seals the locking portion of each of the latch plates to prevent dust, sand or mud from entering the insertion slots of the base, so that the dustproof cover provides a dustproof effect to the base to keep the safety belt buckle operating at a normal condition.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
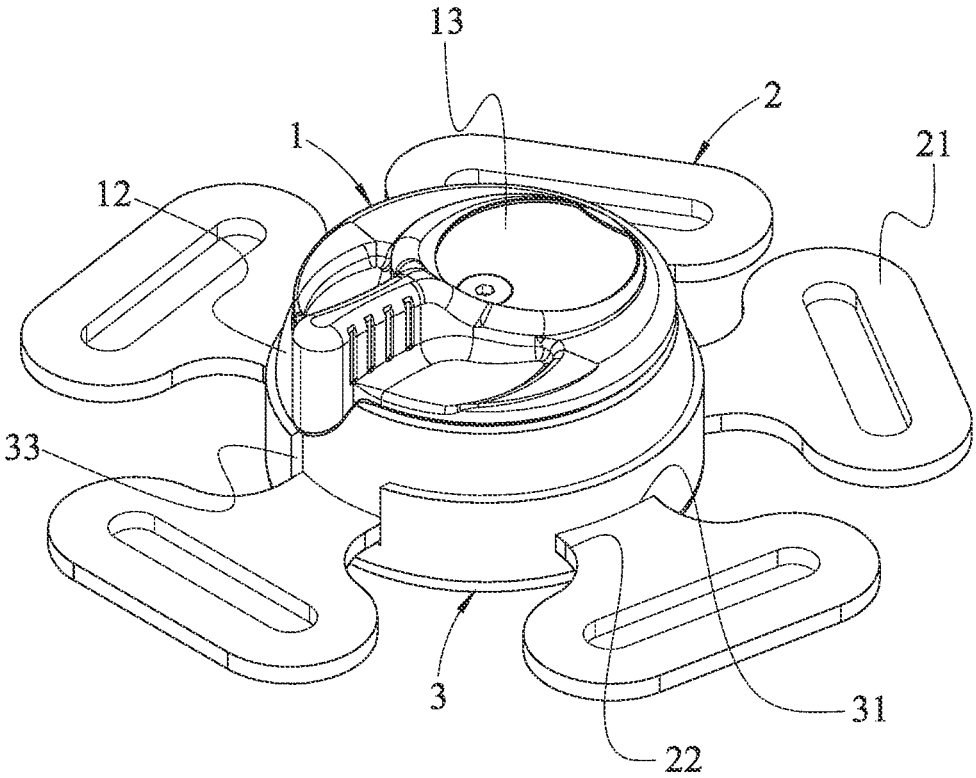
FIG. 1 is a perspective view of a safety belt buckle in accordance with the preferred embodiment of the present invention.
Figure 2:
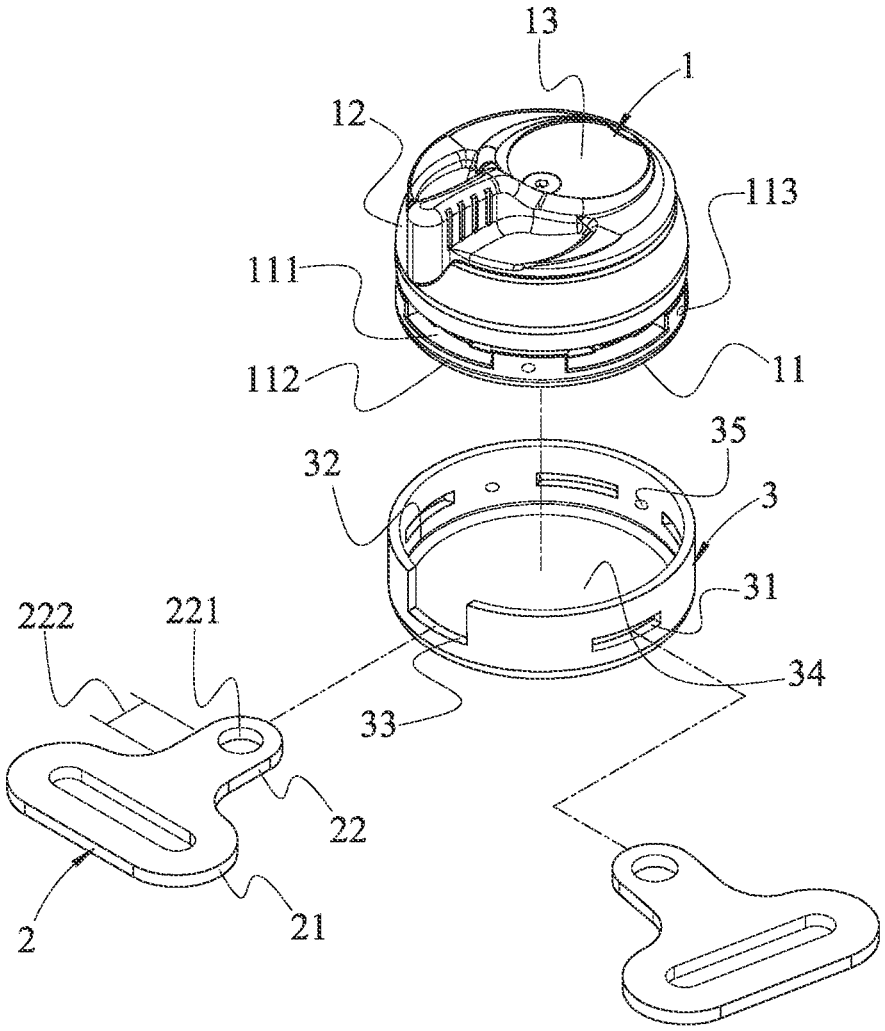
FIG. 2 is a partial exploded perspective view of the safety belt buckle in accordance with the preferred embodiment of the present invention.
Figure 3:
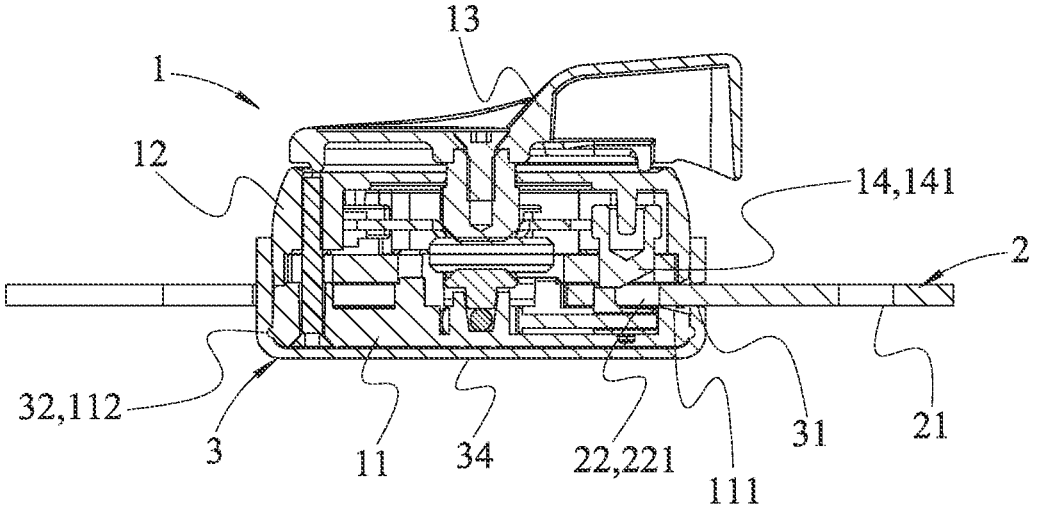
FIG. 3 is a cross-sectional view of the safety belt buckle as shown in FIG. 1.

Referring to FIGS. 1-4, a safety belt buckle in accordance with the preferred embodiment of the present invention comprises a buckle body (or base unit) 1, a plurality of latch plates 2, and a dustproof cover (or stop cover) 3.

The buckle body 1 includes a base 11, a top cap 12, a switch button 13, and a locking mechanism 14. The base 11 is combined with the top cap 12 and has a periphery provided with a plurality of insertion slots 111. The locking mechanism 14 is mounted in the base 11 and sandwiched between the base 11 and the top cap 12. The locking mechanism 14 includes a plurality of spring-biased pins 141 aligning with the insertion slots 111 of the base 11. The switch button 13 is mounted on a top of the top cap 12 and connected with the locking mechanism 14 to control movement of the spring-biased pins 141.

The latch plates 2 are mounted on the buckle body 1. Each of the latch plates 2 has a first end provided with a belt fastening portion 21 and a second end provided with a locking (or snap-fit) portion 22. The belt fastening portion 21 of each of the latch plates 2 is connected with a safety belt. The locking portion 22 of each of the latch plates 2 is inserted into one of the insertion slots 111 of the base 11. The locking portion 22 of each of the latch plates 2 is provided with a locking (or snap-fit) hole 221 allowing insertion of one of the spring-biased pins 141 of the locking mechanism 14 to lock each of the latch plates 2 onto the base 11.

Figure 5:
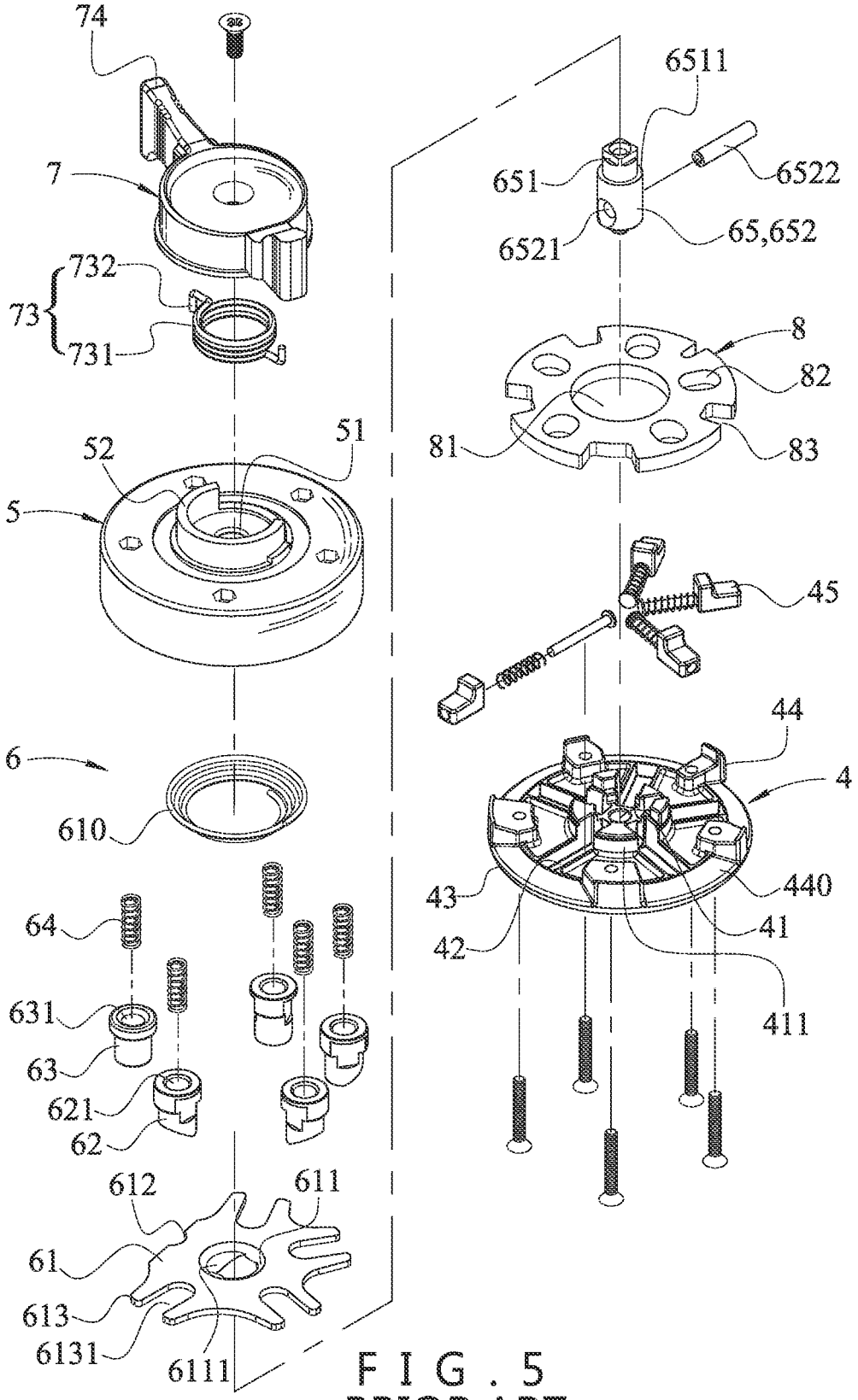
F I G . 5 PRIOR ART
FIG. 5 is an exploded perspective view of a conventional safety belt buckle in accordance with the prior art.
Figure 6:
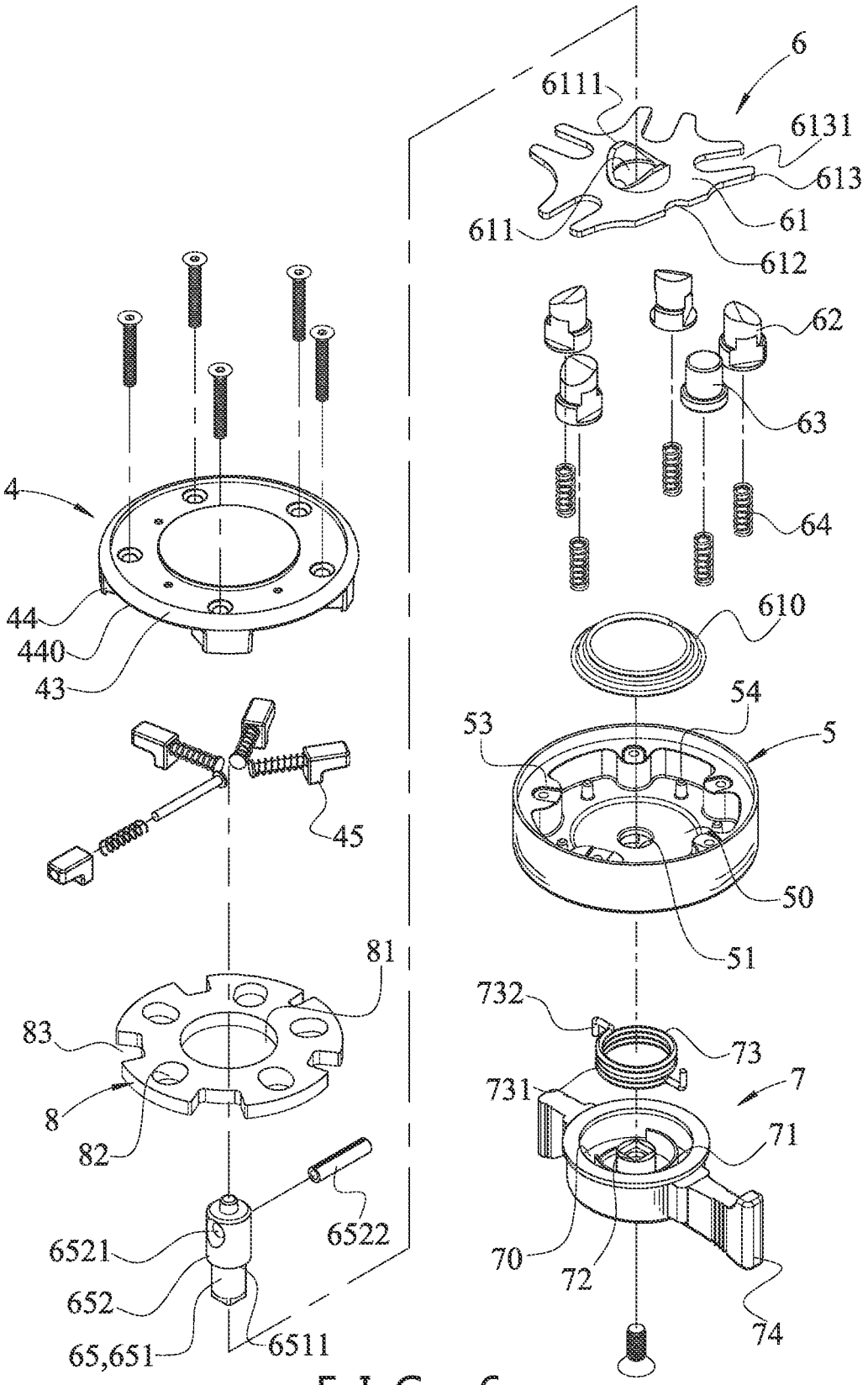
FIG. 6 PRIOR ART
FIG. 6 is another exploded perspective view of the conventional safety belt buckle in accordance with the prior art.

In practice, the safety belt is bound on the belt fastening portion 21 of each of the latch plates 2, the locking portion 22 of each of the latch plates 2 is inserted into one of the insertion slots 111 of the base 11, and each of the spring-biased pins 141 of the locking mechanism 14 is inserted into and locked in the locking hole 221 of the locking portion 22 of one of the latch plates 2 so that the locking portion 22 of each of the latch plates 2 is locked in one of the insertion slots 111 of the base 11, and each of the latch plates 2 is positioned on the base 11. The switch button 13 is connected with the locking mechanism 14. Thus, when the switch button 13 is rotated relative to the base 11, the locking mechanism 14 is activated, and each of the spring-biased pins 141 of the locking mechanism 14 is driven by the switch button 13 and is detached from the locking hole 221 of the locking portion 22 of one of the latch plates 2 so that the locking portion 22 of each of the latch plates 2 is unlocked from one of the insertion slots 111 of the base 11, and each of the latch plates 2 is released and detached from the base 11. The connection and operation of the locking mechanism 14 and the switch button 13 are traditional as disclosed in the conventional safety belt buckle shown in FIGS. 5 and 6, and will not be further described in detail.

In the preferred embodiment of the present invention, the dustproof cover 3 is mounted on a lower end of the base 11 and has a shape corresponding to that of the base 11. Preferably, the dustproof cover 3 has a ring shape. The dustproof cover 3 is provided with a plurality of passages 31 aligning with the insertion slots 111 of the base 11 respectively, and the locking portion 22 of each of the latch plates 2 is inserted through one of the passages 31 of the dustproof cover 3 into one of the insertion slots 111 of the base 11. Each of the passages 31 penetrates a thickness of the dustproof cover 3. The locking portion 22 of each of the latch plates 2 has a width less than that of the belt fastening portion 21 and has a root extension extending outward from the belt fastening portion 21. The locking portion 22 of each of the latch plates 2 is provided with a clamping section 222 which is defined by the root extension of the locking portion 22. The clamping section 222 of each of the latch plates 2 is arranged between the belt fastening portion 21 and the periphery of the base 11 when the locking portion 22 of each of the latch plates 2 is inserted into one of the insertion slots 111 of the base 11. The clamping section 222 of each of the latch plates 2 has a dimension equal to that of each of the passages 31 of the dustproof cover 3 and less than that of each of the insertion slots 111 of the base 11. Thus, the clamping section 222 of each of the latch plates 2 seals one of the passages 31 of the dustproof cover 3 and stops one of the insertion slots 111 of the base 11 when the locking portion 22 of each of the latch plates 2 is inserted through one of the passages 31 of the dustproof cover 3 into one of the insertion slots 111 of the base 11. In addition, the locking portion 22 of each of the latch plates 2 is clamped by one of the passages 31 of the dustproof cover 3 when the locking portion 22 of each of the latch plates 2 is inserted through one of the passages 31 of the dustproof cover 3 into one of the insertion slots 111 of the base 11.

Figure 4:
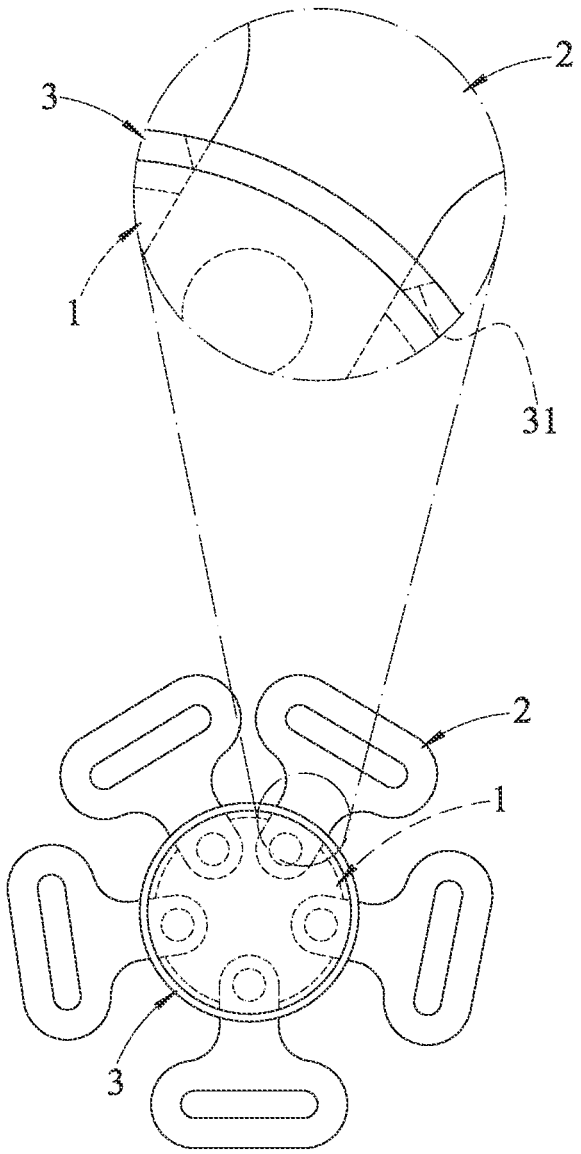
FIG. 4 is a locally enlarged view showing connection of the latch plates and the dustproof cover.

In the preferred embodiment of the present invention, each of the passages 31 of the dustproof cover 3 has two sides each having a width increased gradually from an inner edge toward an outer edge thereof as shown in FIG. 4. Thus, the locking portion 22 of each of the latch plates 2 is swingable slightly in one of the passages 31 of the dustproof cover 3.

In the preferred embodiment of the present invention, the base 11 is provided with a first retaining portion 112, and the dustproof cover 3 is provided with a second retaining portion 32 positioned on the first retaining portion 112 of the base 11.

In the preferred embodiment of the present invention, the first retaining portion 112 of the base 11 is an annular groove, and the second retaining portion 32 of the dustproof cover 3 is an annular flange.

In the preferred embodiment of the present invention, the dustproof cover 3 is provided with an opening 33, and the locking portion 22 of one of the latch plates 2 is inserted through the opening 33 of the dustproof cover 3 into one of the insertion slots 111 of the base 11. The opening 33 penetrates the thickness of the dustproof cover 3. It is noted that, the locking portion 22 of one of the latch plates 2 is inserted into one of the insertion slots 111 of the base 11 and fixed constantly by one of the spring-biased pins 141 of the locking mechanism 14 even when the switch button 13 is rotated to release the latch plates 2, so that one of the latch plates 2 is affixed to the base 11 permanently and will not be detached from the base 11. The one of the latch plates 2 is tied on a carrier to attach the safety belt buckle to the carrier, thereby preventing detachment of the safety belt buckle.

In the preferred embodiment of the present invention, the dustproof cover 3 is made of resilient material and covers the lower end of the base 11.

In the preferred embodiment of the present invention, the dustproof cover 3 has a bottom 34 abutting a bottom of the base 11 when each of the passages 31 of the dustproof cover 3 aligns with each of the insertion slots 111 of the base 11.

In the preferred embodiment of the present invention, the base 11 is provided with a plurality of first positioning portions 113, and the dustproof cover 3 is provided with a plurality of second positioning portions 35 positioned on the first positioning portions 113 of the base 11. The first positioning portions 113 of the base 11 are arranged between the insertion slots 111, and the second positioning portions 35 of the dustproof cover 3 are arranged between the passages 31.

In the preferred embodiment of the present invention, each of the first positioning portions 113 of the base 11 is a convex face, and each of the second positioning portions 35 of the dustproof cover 3 is a concave face.

In the preferred embodiment of the present invention, each of the passages 31 of the dustproof cover 3 has a dimension less than that of the locking portion 22 of each of the latch plates 2. It is noted that, the dustproof cover 3 is made of resilient material so that when the locking portion 22 of each of the latch plates 2 is inserted through each of the passages 31 of the dustproof cover 3, each of the passages 31 of the dustproof cover 3 is pressed and expanded outward by the locking portion 22 of each of the latch plates 2. In such a manner, each of the passages 31 of the dustproof cover 3 is closely fit on and seals the locking portion 22 of each of the latch plates 2.

In the preferred embodiment of the present invention, the dustproof cover 3 has a wall thickness tapered gradually toward each of the passages 31 to increase ductility or malleability of the dustproof cover 3, so that each of the passages 31 of the dustproof cover 3 is enlarged easily by the locking portion 22 of each of the latch plates 2.

Accordingly, each of the passages 31 of the dustproof cover 3 is closely fit on and seals the locking portion 22 of each of the latch plates 2 to prevent dust, sand or mud from entering the insertion slots 111 of the base 11, so that the dustproof cover 3 provides a dustproof effect to the base 11 to keep the safety belt buckle operating at a normal condition, and the locking portion 22 of each of the latch plates 2 is inserted into each of the insertion slots 111 of the base 11 easily and smoothly without being affected by the dust, sand or mud when the safety belt buckle is operated outdoors. In addition, the locking portion 22 of each of the latch plates 2 is swayed in one of the insertion slots 111 of the base 11 to adjust the angle of each of the latch plates 2 to satisfy the user's requirement. Further, the locking portion 22 of each of the latch plates 2 is swayed in one of the insertion slots 111 of the base 11 to prevent each of the latch plates 2 from being jammed or sprung when being subjected to an impact. Further, the locking portion 22 of each of the latch plates 2 is swung slightly in one of the passages 31 of the dustproof cover 3 to facilitate the user adjusting the angle of each of the latch plates 2. Further, the second retaining portion 32 of the dustproof cover 3 is positioned on the first retaining portion 112 of the base 11 when each of the passages 31 of the dustproof cover 3 aligns with each of the insertion slots 111 of the base 11, to facilitate mounting of the dustproof cover 3 on the base 11. Further, the first retaining portion 112 of the base 11 is an annular groove, and the second retaining portion 32 of the dustproof cover 3 is an annular flange, so that the second retaining portion 32 of the dustproof cover 3 is positioned on the first retaining portion 112 of the base 11 easily and quickly. Further, the bottom 34 of the dustproof cover 3 rests on the bottom of the base 11 when each of the passages 31 of the dustproof cover 3 aligns with each of the insertion slots 111 of the base 11 so that the dustproof cover 3 is mounted on the base 11 easily. Further, the dustproof cover 3 made of resilient material is elastically mounted on the lower end of the base 11 so that the dustproof cover 3 is mounted on the base 11 easily and conveniently. Further, the passages 31 of the dustproof cover 3 and the insertion slots 111 of the base 11 are arranged at the same height when the bottom 34 of the dustproof cover 3 rests on the bottom of the base 11, while each of the passages 31 of the dustproof cover 3 aligns with each of the insertion slots 111 of the base 11 when the second retaining portion 32 of the dustproof cover 3 is positioned on the first retaining portion 112 of the base 11, thereby facilitating the user mounting the dustproof cover 3 on the base 11. Further, the dustproof cover 3 is made of resilient material so that the second retaining portion 32 of the dustproof cover 3 is positioned on the first retaining portion 112 of the base 11 easily. Further, the dustproof cover 3 is made of resilient material, and each of the passages 31 of the dustproof cover 3 has a dimension less than that of the locking portion 22 of each of the latch plates 2 so that each of the passages 31 of the dustproof cover 3 is closely fit on and seals the locking portion 22 of each of the latch plates 2 to provide a dustproof function. Further, the dustproof cover 3 is made of resilient material so that the locking portion 22 of each of the latch plates 2 is allowed to sway in one of the passages 31 of the dustproof cover 3 without interference.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A safety belt buckle comprising:

a buckle body, a plurality of latch plates, and a dustproof cover;

wherein:

the buckle body includes a base and a top cap;

the base is combined with the top cap and has a periphery provided with a plurality of insertion slots;

the latch plates are mounted on the buckle body;

each of the latch plates has a first end provided with a belt fastening portion and a second end provided with a locking portion;

the locking portion of each of the latch plates is provided with a locking hole;

the dustproof cover is mounted on a lower end of the base;

the dustproof cover is provided with a plurality of passages aligning with the insertion slots of the base respectively;

the locking portion of each of the latch plates is inserted through one of the passages of the dustproof cover into one of the insertion slots of the base;

the locking portion of each of the latch plates is provided with a clamping section;

the clamping section of each of the latch plates is arranged between the belt fastening portion and the periphery of the base when the locking portion of each of the latch plates is inserted into one of the insertion slots of the base;

the clamping section of each of the latch plates seals one of the passages of the dustproof cover and stops one of the insertion slots of the base when the locking portion of each of the latch plates is inserted through one of the passages of the dustproof cover into one of the insertion slots of the base;

the locking portion of each of the latch plates is clamped by one of the passages of the dustproof cover when the locking portion of each of the latch plates is inserted through one of the passages of the dustproof cover into one of the insertion slots of the base; and each of the passages of the dustproof cover has two sides each having a width increased gradually from an inner edge toward an outer edge thereof, and the locking portion of each of the latch plates is swingable slightly in one of the passages of the dustproof cover.

2. The safety belt buckle as claimed in claim 1, wherein the base is provided with a first retaining portion, and the dustproof cover is provided with a second retaining portion positioned on the first retaining portion of the base.

3. The safety belt buckle as claimed in claim 2, wherein the first retaining portion of the base is an annular groove, and the second retaining portion of the dustproof cover is an annular flange.

4. The safety belt buckle as claimed in claim 1, wherein the dustproof cover is provided with an opening, and the locking portion of one of the latch plates is inserted through the opening of the dustproof cover into one of the insertion slots of the base.

5. A safety belt buckle comprising:

a buckle body, a plurality of latch plates, and a dustproof cover;

wherein:

the buckle body includes a base and a top cap;

the base is combined with the top cap and has a periphery provided with a plurality of insertion slots;

the latch plates are mounted on the buckle body;

each of the latch plates has a first end provided with a belt fastening portion and a second end provided with a locking portion;

the locking portion of each of the latch plates is provided with a locking hole;

the dustproof cover is mounted on a lower end of the base;

the dustproof cover is provided with a plurality of passages aligning with the insertion slots of the base respectively;

the locking portion of each of the latch plates is inserted through one of the passages of the dustproof cover into one of the insertion slots of the base;

the locking portion of each of the latch plates is provided with a clamping section;

the clamping section of each of the latch plates is arranged between the belt fastening portion and the periphery of the base when the locking portion of each of the latch plates is inserted into one of the insertion slots of the base;

the clamping section of each of the latch plates seals one of the passages of the dustproof cover and stops one of the insertion slots of the base when the locking portion of each of the latch plates is inserted through one of the passages of the dustproof cover into one of the insertion slots of the base;

the locking portion of each of the latch plates is clamped by one of the passages of the dustproof cover when the locking portion of each of the latch plates is inserted through one of the passages of the dustproof cover into one of the insertion slots of the base;

the dustproof cover is made of resilient material and covers the lower end of the base; and the dustproof cover has a bottom abutting a bottom of the base when each of the passages of the dustproof cover aligns with each of the insertion slots of the base.

6. The safety belt buckle as claimed in claim 5, wherein:

the base is provided with a plurality of first positioning portions;

the dustproof cover is provided with a plurality of second positioning portions positioned on the first positioning portions of the base;

the first positioning portions of the base are arranged between the insertion slots; and the second positioning portions of the dustproof cover are arranged between the passages.

7. The safety belt buckle as claimed in claim 6, wherein each of the first positioning portions of the base is a convex face, and each of the second positioning portions of the dustproof cover is a concave face.

8. A safety belt buckle comprising:

a buckle body, a plurality of latch plates, and a dustproof cover;

wherein:

the buckle body includes a base and a top cap;

the base is combined with the top cap and has a periphery provided with a plurality of insertion slots;

the latch plates are mounted on the buckle body;

each of the latch plates has a first end provided with a belt fastening portion and a second end provided with a locking portion;

the locking portion of each of the latch plates is provided with a locking hole;

the dustproof cover is mounted on a lower end of the base;

the dustproof cover is provided with a plurality of passages aligning with the insertion slots of the base respectively;

the locking portion of each of the latch plates is inserted through one of the passages of the dustproof cover into one of the insertion slots of the base;

the locking portion of each of the latch plates is provided with a clamping section;

the clamping section of each of the latch plates is arranged between the belt fastening portion and the periphery of the base when the locking portion of each of the latch plates is inserted into one of the insertion slots of the base;

the clamping section of each of the latch plates seals one of the passages of the dustproof cover and stops one of the insertion slots of the base when the locking portion of each of the latch plates is inserted through one of the passages of the dustproof cover into one of the insertion slots of the base;

the locking portion of each of the latch plates is clamped by one of the passages of the dustproof cover when the locking portion of each of the latch plates is inserted through one of the passages of the dustproof cover into one of the insertion slots of the base;

the dustproof cover is made of resilient material and covers the lower end of the base; and each of the passages of the dustproof cover has a dimension less than that of the locking portion of each of the latch plates.

9. The safety belt buckle as claimed in claim 8, wherein the dustproof cover has a wall thickness tapered gradually toward each of the passages.

* * * * *